US005104338A

United States Patent [19]

Mitra

[11] Patent Number: 5,104,338

[45] Date of Patent: Apr. 14, 1992

[54] COVER DEVICE

[75] Inventor: Niranjan Mitra, Eindhoven, Netherlands

[73] Assignee: E. I. Du Pont de Nemours and Company, Wilmington, Del.

[21] Appl. No.: 652,971

[22] Filed: Feb. 11, 1991

[30] Foreign Application Priority Data

Feb. 9, 1990 [NL] Netherlands ..... 9000317

[51] Int. Cl.[5] ..... H01R 9/07

[52] U.S. Cl. ..... 439/495; 439/438; 439/266

[58] Field of Search ..... 439/329, 67, 77, 492–499, 439/438–441, 266

[56] References Cited

U.S. PATENT DOCUMENTS 4,373,765 2/1983 Ritter ..... 339/75
4,406,511 9/1983 Hayes ..... 339/103
4,695,112 9/1987 Maston et al. ..... 439/350
4,705,482 11/1987 Endo et al. ..... 439/492
4,718,859 1/1988 Gardner ..... 439/329
4,824,379 4/1989 Roberts et al. ..... 439/329

FOREIGN PATENT DOCUMENTS 0302452 2/1989 European Pat. Off. ..... 439/492
2618673 11/1977 Fed. Rep. of Germany ..... 439/492

*Primary Examiner*—David L. Pirlot

[57] ABSTRACT

Cover device for a flat cable having an aperture in the insulation between the conductors. The cover device comprises two opposite arms, each having a first and second end. The arm are connected by a flexible cross member. This cross member is provided with a locking lip which extends in the direction of the first end of the arms and having at its free end a locking lobe for insertion in the aperture of the cable. By making the locking lobe barb-shaped the cable can be inserted into the cover device by a snap action. Polarization-indicating means are provided for positioning the cable correctly relative to the cover device. Preferably, the cover device may be combined with an electric connector.

9 Claims, 4 Drawing Sheets

COVER DEVICE

BACKGROUND OF THE INVENTION

The present invention relates to a cover device.

In the prior art it is known to introduce flat cables in connectors. Before introduction the insulation is stripped from the extremity of the cable such that the conductors are exposed. Such connectors can comprise wire trap connectors such as described in copending U.S. application Ser. No. 07/536,342 filed June 11, 1990 and assigned to same assignee as the present application. A feature of this wire trap is that it is also possible to disengage a cable from the trap. Although it is possible in most cases to effect introducing and releasing of the cable from the connector in a condition wherein the related device is switched off, there are situations wherein during (partially) functioning of the related device the cable has to be introduced or removed. Furthermore under severe conditions working loose of the cables has been observed (such as by vibrations). In all these conditions the danger of short circuiting because of the bare conductors or otherwise undesired contacting arises.

SUMMARY OF THE INVENTION

The invention aims to provide a cover device for a flat cable which can protect the bare conductor extremities of said cable, said cover device being used together with a connector.

According to the invention a cover device has been proposed for a flat cable provided near one end with means to engage the cable and provided near the other end with means to releasably engage a connector, wherein the means to engage said cable comprise lug means to be introduced in at least one opening provided in the cable. The expression "connector" is used to encompass all kinds of devices to which a cable can be fixed.

The means to releasably engage the connector do protect the unisolated extremities of the cable against short circuiting, such that it is possible to introduce and remove the cable in and from the connector respectively whilst under voltage and also no further detrimental effects result from working loose of the cable from the connector during operation or shipment from vibrations.

According to a preferred embodiment of the invention the means to engage the connector are arranged to allow only one position of introduction of the cover device into the connector. Once fitted to the cable in this way correct positioning of the cable relative to the connector will be obtained. This is in particular of interest if more than one conductor lead is provided in the cable.

According to a further preferred embodiment the position of the flat cable relative to the cover device is fixed in that the lug means are arranged to allow only one position of introduction into the at least one opening of the cable.

In combination with connectors, such as wire traps, it is necessary to be able to move the cable relative to the connector to make or disconnect the connection between the exposed extremity of the conductor and the contact within the connector. To allow such displacement according to the invention the lug means have a size in the direction of introduction of the cable which is substantially smaller than said opening in the cable in the direction of introduction of the cable.

According to a preferred embodiment of the cover device described above it comprises a bridge member from which the means to engage the cable extend in one direction and from which the means to engage the connector extend in the opposite direction. Preferably the lug means are connected to said bridge member through lug means. According to a further preferred embodiment gripping means are provided for controlling the movement of the lug means being parallel and spaced from the means to engage the connector.

As indicated above the cover device according to the subject application can be used with a wire trap connector such as described in the aforenoted U.S. application Ser. No. 07/536,342. If such a wire trap comprises an upper part being removably arranged relative to a lower part in which the contact is arranged, preferably a cover device according to the invention is integrated with the upper part.

As indicated above the flat cable to be used with a cover assembly must have an opening with a size in the direction of introduction being at least several times the length of the means which project in the opening of the cover device to allow movement in the direction of introduction (or removal) of the cable relative to the cover. If a bridge member is used in the cover device the cable preferably comprises a recess to receive this bridge member.

BRIEF OF DESCRIPTION OF THE DRAWINGS

The invention will be explained below with reference to a number of examples of embodiments shown in the drawing, in which:

FIGS. 1*a*–1*b* show in side view a cable and a cover device according to the invention, not fitted;

FIGS. 2*a*–2*e* show the cover device with the cable according to FIG. 1 in side view, and partially in cross-section, fitted in different positions relative to a connector;

FIGS. 3*a*–3*b* show top views of the connector and cover device according to FIGS. 1; 2 and FIGS. 4*a*–4*c* show a further embodiment in different positions of the cover device according to the invention, combined with a connector;

FIG. 5 shows another embodiment of the cover device according to the invention; and FIGS. 6*a*–6*b* show a modified embodiment in different positions of the cover device according to the invention.

DETAILED DESCRIPTION OF PREFERRED EMBODIMENTS

Figure 1A:
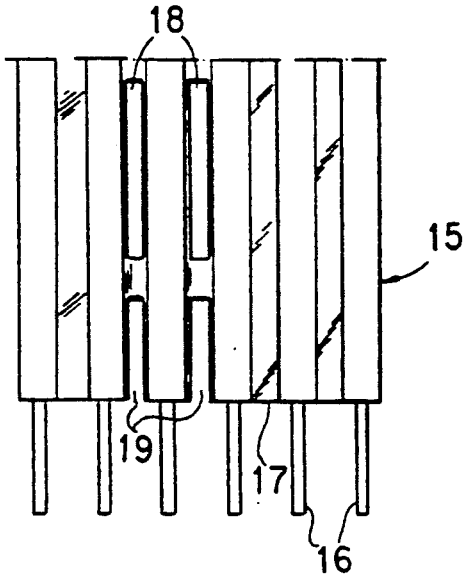
Figure 1B:
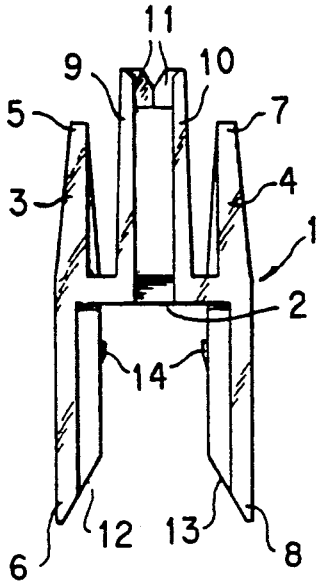

In FIG. 1 the cover device according to the invention is shown in its entirety by 1. It comprises a body part 2 and arms 3 and 4. Arm 3 is provided with a first end 5 and a second end 6, and arm 4 is provided with a first end 7 and a second end 8. Locking lips 9 and 10, provided with locking lobes 11, are fitted on the body 2. Second ends 6 and 8 are provided with bevels 12 and 13.

FIG. 1 also shows a cable, shown in its entirety by 15. It comprises conductors 16 with insulation 17 between them. It can be seen that locking apertures 18 and apertures 19 determining the polarity are located in the insulation.

Figure 2A:
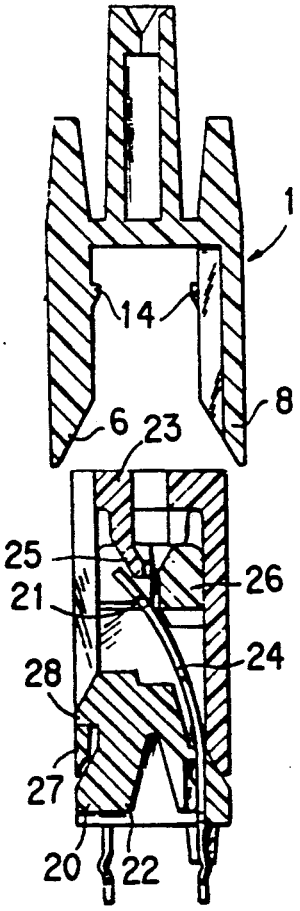

FIG. 2*a* shows a combination of the cover device according to FIG. 1 and a connector 20 which is described in greater detail in the aforenoted U.S. application Ser. No. 07/536342 and incorporated by reference herein. The connector comprises two parts 22, 23 which can be moved relative to each other. The part 22 is provided with a resilient tongue 21 having an aperture 24, and the movable part 23 is provided with a bevel 25, which can engage on the top end of tongue 21. Movable part 22 is provided with a support 26.

Figure 2B:
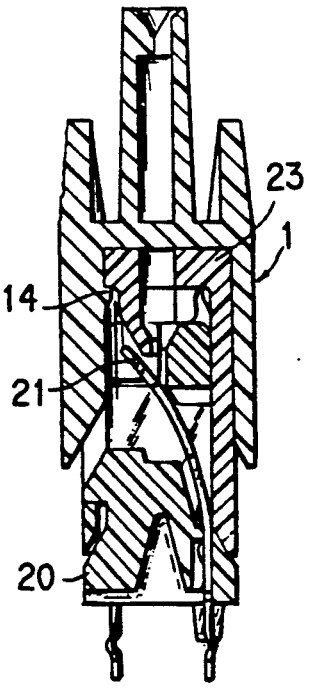

FIG. 2*b* shows the position on placing of cover device 1 on connector 20. Lobes 14 engage behind a recess in the movable part 23. Through pressing down cover device 1 from the situation shown in FIG. 2*a*, the second ends 6 and 8 will move apart, and the lobes 14 will move along the movable part 23 and snap behind it. Releasing can be achieved by moving the first ends 5, 7 of the arms 3, 4 towards each other.

Figure 2C:
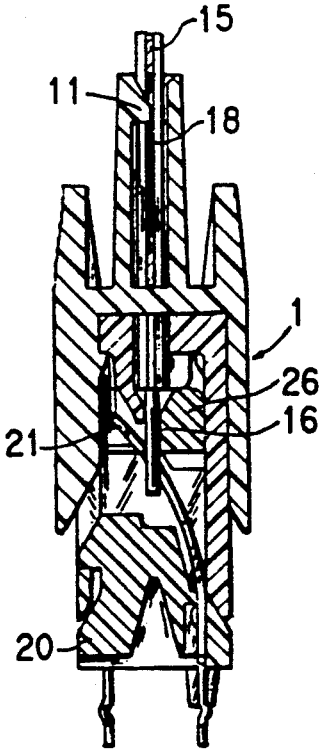

FIG. 2*c* shows the situation during insertion of cable 15. Cable 15 is moved along locking lobes 11. This is possible without special operation of the cover device 1 through the fact that said locking lobes 11 are bevelled. Cable 15 cannot be taken down further than the top boundary of the aperture 19 engaging the body part 2. Through the presence of these apertures, the cable can be taken far down enough in only one position, so that the conductor 16 in the connector can come into contact with tongue 21. Through the downward movement of the conductor 16, tongue 21 will bend away, but conductor 16 cannot move back because tongue 21 together with supporting face 26 provides an efficient lock.

Figure 2D:
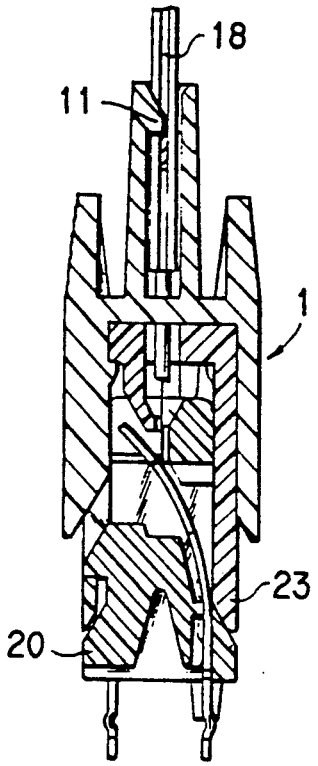
Figure 2E:
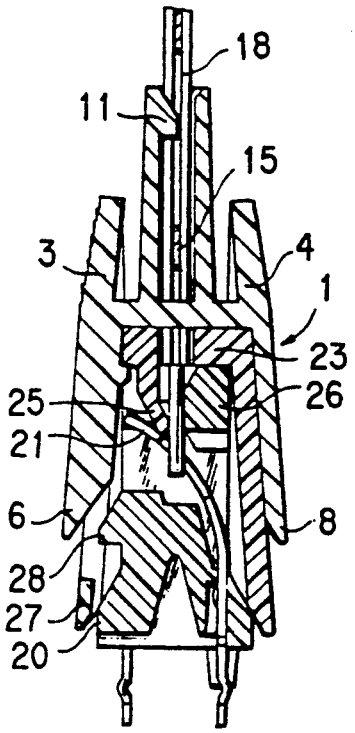

FIG. 2*d* shows the situation during withdrawal. It can be seen that the boundary of aperture 18 comes to rest against locking lobe 11 and thus the cover device effectively prevents the cable from moving back. On further movement of the cover device 1 and part 22 of the connector towards each other, surface 27 of part 23, which is normally held behind lobe-shaped projection 28 of part 22, will move outwards. Part 25 will also press tongue 21 downwards, so that the cable is no longer pressed against supporting point 26. This makes it possible to remove cable 15 together with cover device relief 1 and part 23 from part 22.

Opening 18 in cable 15 is elongated to allow movement of cable 15 relative to locking lobes 11. This movement of cable 15 relative to cover device 1 is of importance during introduction, removal respectively of conductor 16 from tongue 21. If cover device 1 is connected to cable 15 and cover device 1 is not connected to the connector, it is prevented that conductors 16 can short circuit, contact any part of the related device or the person effecting contact or withdrawal by virtue of the protecting first end 7 and second end 8. By engaging these ends 6 and 8 of the cover device 1 in the condition not introduced in the connector, but provided with cable 15, locking lobes 11 come apart such that it is possible to remove cable 15 from the locking device 1 according to the invention.

Figure 3A:
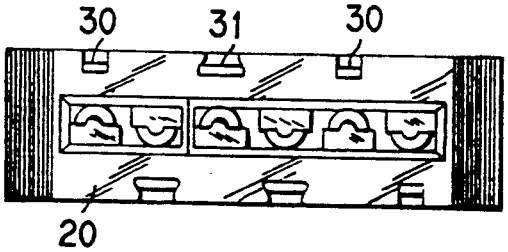
Figure 3B:
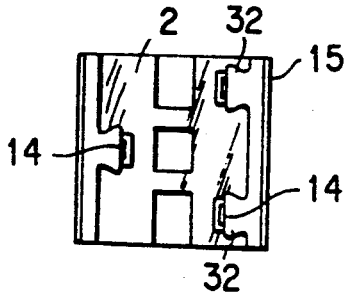

FIG. 3*a* shows a top view of connector 20 according to FIG. 2. It can be seen that it is provided with different guide slots 30, 31. Guide slot 31 is dovetailed in this case. A corresponding top view of the cover device 1 is shown in FIG. 3*b*. It can be seen that it is provided with projections 32 of corresponding dovetailed shape. In this way it is ensured that the cover device 1 can be placed on the connector 20 only in one position. The precise location of the cable 15 through the apertures 19 relative to the cover device 1 and the precise location of cover device 1 relative to connector 20 ensures precise location of the cable 15 relative to the connector 20.

Figure 4A:
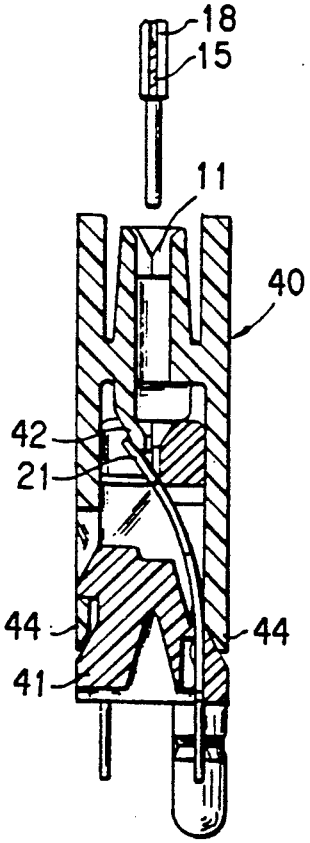
Figure 4B:
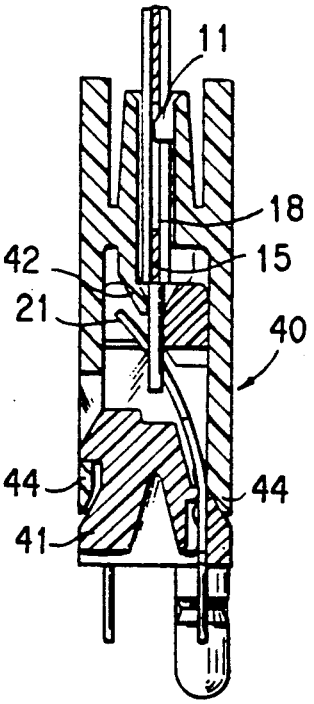
Figure 4C:
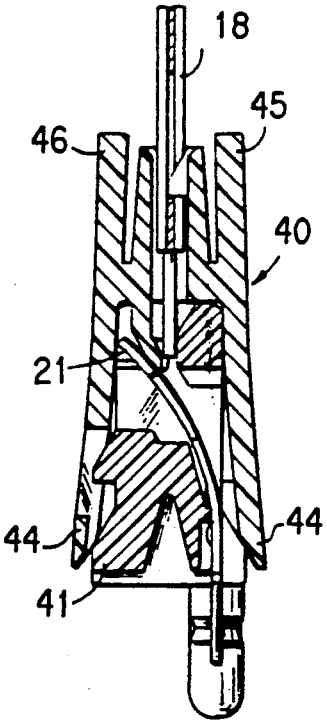

FIGS. 4*a*–4*c* show a further embodiment of the invention. In this case the cover device is indicated in its entirety by 40. Apart from the parts described above, the cover device functions as a second part of the connector 41. For this purpose, it is provided with a bevel 42 which can engage with tongue 21 of part 41 of the cover device. This is shown in FIG. 4*a*, in which the cable is shown in the position for fitting in the cover device or connector. FIG. 4*b* shows the situation during fitting. Through moving the cover device 40 and the connector 41 towards each other, the second ends 44, 45 of the arms of the cover device will be moved outwards and tongue 21 will be pressed away by bevelled part 42. After this, cable 15 can be moved upwards to such an extent that the boundary of aperture 18 touches locking lobe 11. Subsequently, when the first ends 45 and 46 are pressed in, cover device 40 can be detached from connector 41 together with the cable 15. Locking lobe 11 can be moved out of aperture 18 by pressing the two ends 44 into the position detached from each other.

Figure 5:
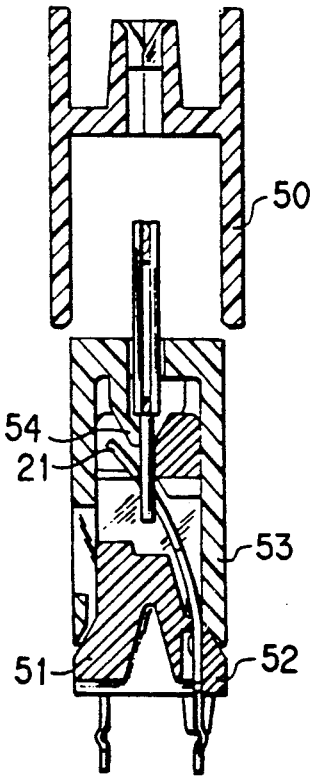

FIG. 5 shows a further embodiment of the invention. In this case cover device 50 is engaged, by means not shown in any further detail, with connector 51, comprising parts 52 and 53. When cover device 50 is pressed onto part 53, the bevelled part 54 thereof is pressed against tongue 21, and the passage for the cable is released.

Figure 6A:
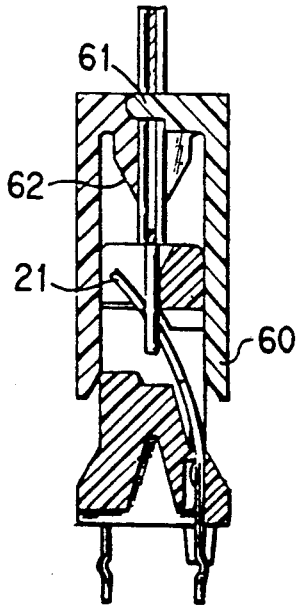
Figure 6B:
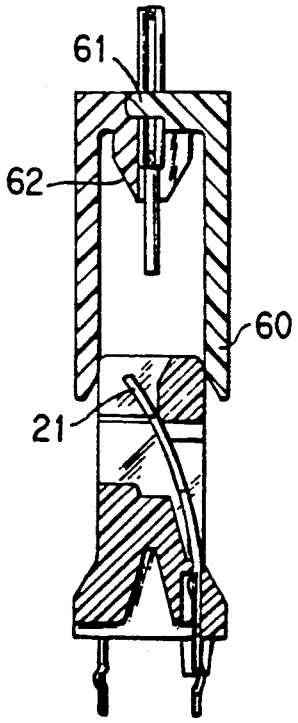

FIGS. 6*a*, 6*b* show a further modified embodiment of the invention. In this case the cover device is indicated by 60 and the locking lobe comprises a part 61 projecting from the body. The body is provided with a bevel 62 to operate tongue 21.

Although the invention is described above with reference to preferred embodiments, it must be understood that numerous modifications can be made thereto, without going beyond the scope of the present invention. It is therefore possible to use the cover device for all kinds of connectors.

I claim:

1. A connector for releasably engaging and electrically contacting a flat cable having a plurality of conductors, comprising a housing of electrically insulating material having at least one aperture at a first end for receiving the conductors of said flat cable, said housing also having disposed therein a plurality of contact elements for electrically contacting respective ones of said cable conductors, a cover member for engaging said flat cable prior to insertion of said conductors into said housing, said cover member adapted for releasable attachment with or without said cable to said housing and for releasable engagement and electrical contact of said cable conductors with the contact elements of said housing, said cover member including at least one pair of arms having first ends extending toward and adapted to releasably attach to said connector housing in only one polarity and second ends extending in an opposite direction and adapted to be manipulated to release said first ends from said housing, at least one pair of locking lips disposed between and extending in the same direction as the second ends of said arms, said locking lips having locking lobes at their free ends to engage at least one pair of apertures on said flat cable in only one polarity when the flat cable is inserted into said cover member, and wherein placing said cover member on said first end of the housing so as to move said first ends of the arms to a first position along said housing will latch the cover member to the housing and will lockingly engage and electrically contact each of the cable conductors with a respective contact element of said housing, and wherein further movement of said cover member so as to move said first ends of the arms of the cover member to a second position which will disengage each of said cable conductors from its respective contact element, thus releasing and permitting removal of said cover member and cable from said housing.

2. The connector of claim 1 wherein the locking lobes are beveled.

3. The connector of claim 1 wherein said first ends of the arms are beveled.

4. The connector of claim 1 wherein said first ends of the arms include latching lobes which engage an edge of said housing to latch the cover to said housing.

5. A flat multiconductor cable for use with the connector of claim 1, said cable having insulation separating the conductors and said apertures in the cable being disposed in the insulation between adjacent conductors, said apertures having a length at least several times the length of the locking lobes.

6. The connector of claim 1 wherein said connector is wire trap connector.

7. The connector of claim 1, wherein said housing comprises a first and second parts adapted to move relative to one another and wherein said further movement of the arms of said cover member to said second position will cause said first part to move relative said second part to disengage said cable conductors from the contact elements.

8. The connector of claim 7, wherein said first part of the housing is removable with the cover member from the second part of the housing.

9. The connector of claim 7, wherein the cover member and the first part of the housing are integral and function both as the cover member and the first part of the housing.

* * * * *